United States Patent [19]

Orenstein

[11] 4,105,885

[45] Aug. 8, 1978

[54] HAND OPERATED INSTRUMENTS HAVING NON-MAGNETIC SAFETY SWITCH

[75] Inventor: Henry Orenstein, Verona, N.J.

[73] Assignee: Consumer Concepts, Inc., Union, N.J.

[21] Appl. No.: 698,713

[22] Filed: Jun. 22, 1976

[51] Int. Cl.[2] ..... H01H 35/00; H01H 9/06; F41C 19/12; A44C 13/00

[52] U.S. Cl. ..... 200/52 R; 42/70 E; 42/84; 200/42 R; 200/DIG. 2; 200/157; 63/1 R; 340/573

[58] Field of Search ..... 63/1 R, 1 A, 2 R, 15, 63/29 M; 42/1 R, 1 LP, 17, 70 E, 84; 128/138 R; 200/DIG. 2, 52 R, 42 R, 44, 61.58 R, 51 R, 51.09, 51.1, 153 LB, 157, 164 R; 124/32, 40; 340/279; 335/205, 206

[56] References Cited

U.S. PATENT DOCUMENTS

| | | | |
|---|---|---|---|
| 477,940 | 6/1892 | Hurd | 200/DIG. 2 X |
| 765,261 | 7/1904 | Wise | 128/138 UX |
| 1,029,037 | 6/1912 | Young | 42/17 |
| 1,296,088 | 3/1919 | Jones | 200/157 X |
| 2,223,657 | 12/1940 | Baden | 63/15 X |
| 2,453,190 | 11/1948 | Boscowitz | 63/1 R |
| 2,735,908 | 2/1956 | Peretti et al. | 200/42 R X |
| 2,882,636 | 4/1959 | Shinaver | 42/70 E |
| 3,307,374 | 3/1967 | Kirshbaum | 63/1 R |
| 3,370,137 | 2/1968 | O'Connor | 200/42 R |
| 3,531,607 | 9/1970 | Donahue et al. | 200/153 LB X |
| 3,571,544 | 3/1971 | Sheehan | 335/205 X |
| 3,632,916 | 1/1972 | Schaad | 200/42 R |
| 3,654,411 | 4/1972 | Wohnlich et al. | 200/51.1 X |
| 3,673,725 | 7/1972 | Cravener | 42/1 LP |
| 3,750,062 | 7/1973 | Goto | 340/279 X |
| 3,773,990 | 11/1973 | Maci | 200/157 X |
| 3,777,086 | 12/1973 | Riedo | 200/DIG. 2 X |
| 3,978,604 | 9/1976 | Smith | 42/70 E |
| 3,983,347 | 9/1976 | Brenzen | 200/157 |

FOREIGN PATENT DOCUMENTS

| | | | |
|---|---|---|---|
| 1,140,952 | 12/1962 | Fed. Rep. of Germany | 200/61.58 R |

OTHER PUBLICATIONS

Johnson, R. A.; IBM Tech. Disc. Bull.; Pushbutton Key With No Moving Parts; vol. 13; No. 11; Apr. 1971, p. 3351.

New World Trnslation of the Holy Scriptures, Book of Genesis, Chapter 4, first verse, p. 12, first revision, 1961.

Washington Post, "Device Could Have Foiled Slaying of D.C. Officer", Lewis et al. Section C, p. 2, Oct. 19, 1976.

*Primary Examiner*—James R. Scott

*Attorney, Agent, or Firm*—George E. Kersey

[57] ABSTRACT

Operator controlled devices in the form of hand operated instruments in which a ring worn by an operator is configured to be insertable into a recess in a hand holdable portion of the instrument. The recess includes a fixed contact configuration that is engagable by a non-magnetic bridging contactor on an outer peripheral face of the ring, so that the instrument becomes operational when the contactor is inserted into the recess and engages the fixed contact configuration.

10 Claims, 5 Drawing Figures

L
25
25c-1
S
25c-2
25s
B
31b
31a
31'
31c

31'
31a
31c
25
28
29n
29
25n
28s
28e
29s
A
25s
24
20'
22'
21'
25
31a
31b
31c
31'
R'
26
27

HAND OPERATED INSTRUMENTS HAVING NON-MAGNETIC SAFETY SWITCH

BACKGROUND OF THE INVENTION

This invention relates to hand operated devices, and, more particularly, to such devices in which complementary members must be engaged before the devices can be operated.

Hand operated devices take many forms; and can be used for actual or simulated operations. One well known form is provided by a tool or weapon which is not to be operated until certain preliminary conditions have been satisfied. A safety interlock can be provided for that purpose, but an interlock has a number of disadvantages. It does not prevent an unauthorized person from operating the device; the operator may believe that the interlock is active when it is not; and effective interlocks are generally mechanically complex.

Accordingly, it is an object of the invention to expedite the provision of tools or weapons for restricted actual or simulated operation.

Another object of the invention is to achieve restricted and simplified operation of operator controlled tools and weapons.

A further object is to achieve restricted operation in tools and weapons without the need for a conventional interlock. A related object is to attain the effectiveness of a secure interlock without the attendant cost and complexity.

Still another object of the invention is to prevent unauthorized persons from using an operator controlled device. An associated object is to do so in a simple way.

Yet another object of the invention is to assure the inoperability of an operator controlled device until certain preliminary conditions have been satisfied.

SUMMARY OF THE INVENTION

In accomplishing the foregoing and related objects, the invention provides a ring which is worn by an operator to control and complement a hand operatable instrument, which may be in the form of an actual or simulated tool or weapon.

In accordance with one aspect of the invention, the operator worn member ring is configured to be insertable into a complementary aperture of the controlled tool or weapon. Since the ring is worn by the operator, it is not easily misplaced, and only authorized operators may be provided with it.

In accordance with a further aspect of the invention, the operator worn ring has a non-magnetic raised structure which fits into a complementary recess of the tool or weapon. The raised structure may complete an electrical circuit, to actuate the tool or weapon, or the raised structure may actuate a mechanical member to render the tool or weapon operable.

DESCRIPTION OF THE DRAWINGS

Other aspects of the invention will become apparent after considering several illustrative embodiments, taken in conjunction with the drawings in which.

DETAILED DESCRIPTION

Figure 1:
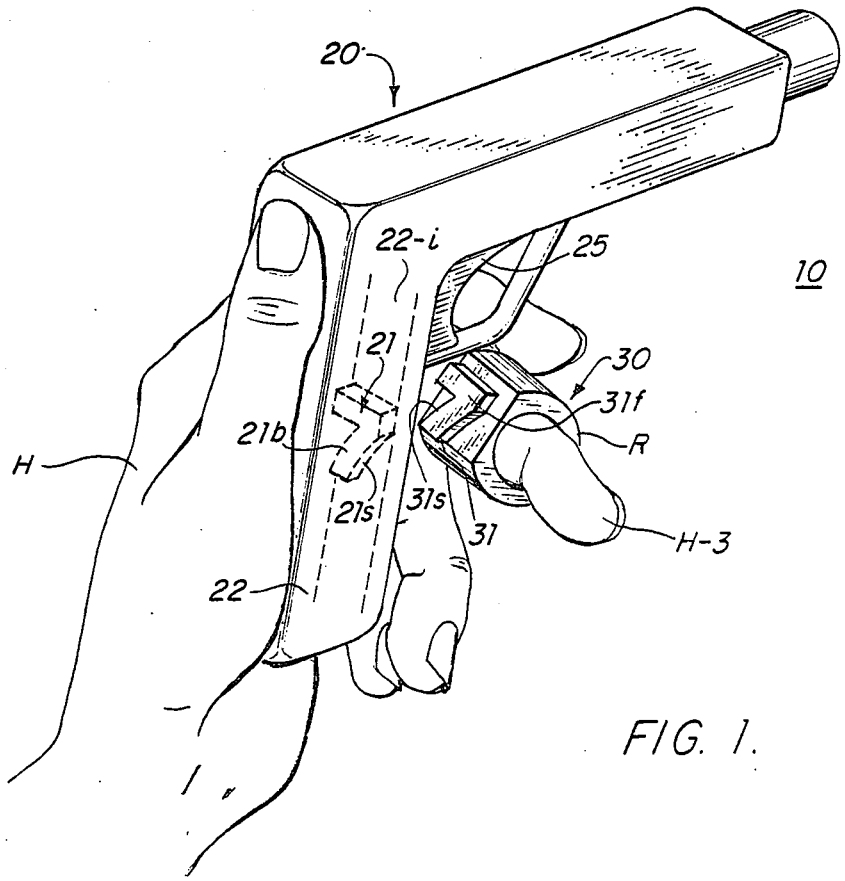
FIG. 1 is a perspective view of a hand operated device in accordance with the invention.

Turning to the drawings, an operator controlled device or system 10 in accordance with the invention is shown in FIG. 1 formed by a simulated weapon 20 and a complementing control ring 30 or R.

The complementing control ring R which is worn on the hand H of the operator of the system 10. The ring R includes a non-magnetic asymmetric raised portion or bridging contactor 31, which illustratively is in the form of the number "7". Accordingly, the contactor or protuberance 31 of the ring R has a face portion 31*f* and side portions 31*s*.

The simulated weapon 20 has a hand holdable portion with a recess 21 which has fixed configuration contact and is proportioned to receive the contactor protuberance 31. Hence the recess 21 has side walls 21*s* and a base 21*b*. When the protuberance 31 of the ring R is inserted into the recess 21, the instrument 20 is rendered operable. This may take place electrically or mechanically, as described below in conjunction with the description of FIG. 4A and 4B.

The system 10 of FIG. 1 is designed so that the control ring R can be worn on one of the interior fingers of the hand H, e.g., the middle finger H-3. As a result, the complementary aperture 21 in the gun 20 is on the interior side 22*i* of the handle 22.

Figure 2:
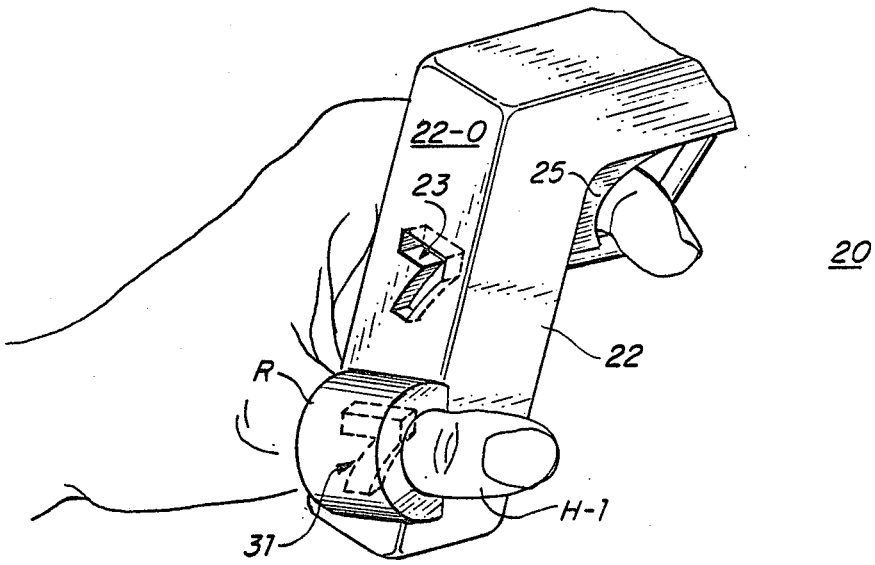
FIG. 2 is a perspective view of an alternative embodiment of the invention.

In the embodiment of FIG. 2, the complementary aperture 23 is on the outer side 22-o of the handle 22. This allows the operator to wear the control ring R on his thumb H-1, and still be able to control the operation of the gun 20. It will be apparant that alternative control apertures may be provided on the same tool.

Figures 3, 4A, 4B:
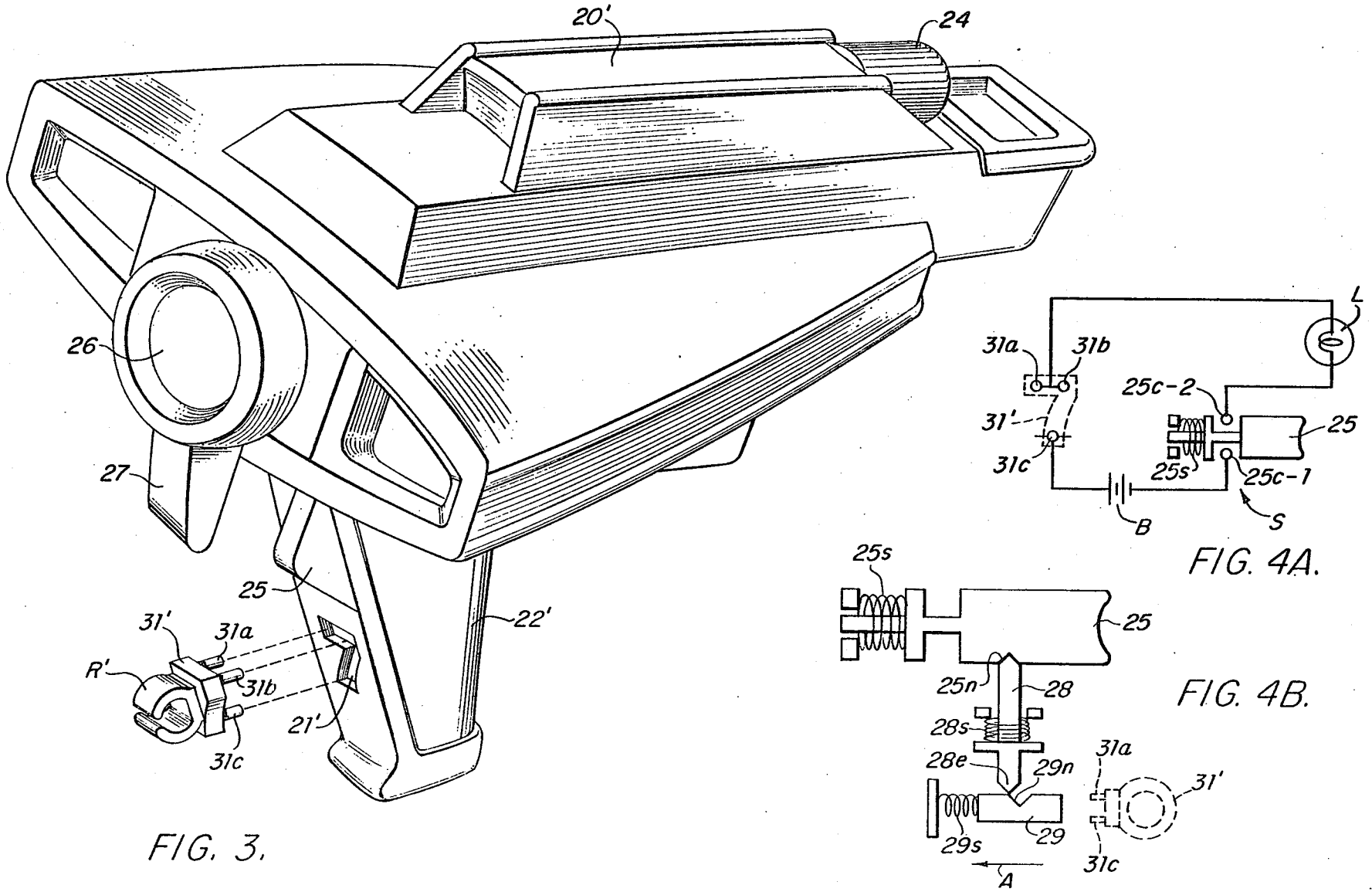
FIG. 3 is a perspective view of another alternative embodiment of the invention.
FIGS. 4A and 4B are schematic diagrams of control circuitry in accordance with the invention.

In the embodiment of FIG. 3, the gun 20 is in the form of a rocket toy, and the contactor protuberance 31 of the control ring R closes an electric circuit so that the operator is able to produce a ray of light, by, for example, the circuitry of FIG. 4A.

The ring R′ is worn, illustratively, in the same fashion as the ring R of FIG. 2 on the middle finger, and the handle 22′ of the gun 20′ is gripped, with the protuberance 31′ of the ring R inserted into the aperture 21′. In addition, the contactor protuberance 31′ has lugs 32*a* through 32*c* to assure good contact with the interior circuitry of the gun 20′, which is described below.

The operator is then able to sight on a proposed target using the view finder 24. When the trigger 25 is depressed (by an index finger, not shown in FIG. 3), a ray of light is produced, by regular flashlight action, at the lens 26. The lens mount 27 is adjustable to permit focussing of the light beam thus produced.

The ring R′ is open at the back side to facilitate adjustability. It will be understood that the control rings R and R′ may take a variety of forms and that the asymmetric form illustrated is particularly advantageous in preventing accidental operation of the tool with which it is used.

An illustrative electrical control circuit for a tool or weapon in accordance with the invention is shown in FIG. 4A. When the protuberance 31 of the ring R is inserted into a recess 21 or 23 it completes a circuit from a battery B through a lamp L to a switch S. In the case of the gun 20′ of FIG. 3, the protuberance 31′ is metallic and the prongs 31*a* through 31*c* engage contact plates 21*c*-1 and 21*c*-2; and the switch S includes the trigger 25. Consequently, when the trigger 25 is depressed, against a spring 25*s*, it engages contacts 25*c*-1 and 25*c*-2 to complete the circuit and produce illumination at the lens 26 (FIG. 3) from the lamp L.

A mechanical control circuit that is suitable for practicing the invention is shown in FIG. 4B. Movement of the trigger 25 is prevented by a stop 28 which engages a notch 25*n* in the trigger bar. When a slide 29 is pushed against a spring 29*s* in the direction indicated by the arrow A, for example, by the prongs 31*a* and 31*c* of the protuberance 31' (shown in phantom) the end 28*e* of the stop 28 is forced by the spring 28*s* into a notch 29*n*, releasing the trigger 25, so that it may be depressed to operate the instrument in which it is contained.

While various aspects of the invention have been set forth by the drawings and the specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A hand operated instrument which comprises a housing;

a recess in a hand holdable portion of said housing;

said recess having fixed configuration contact means therein;

said contact means being engagable by a non-magnetic bridging contactor on an outer peripheral face of a ring worn by the operator of said instrument; and said bridging contactor being insertable in said recess and engages said contact means whereby said instrument becomes operational.

2. A hand operated instrument in accordance with claim 1 wherein said contactor is a raised portion of said ring.

3. An instrument in accordance with claim 2 wherein said raised portion is asymmetric.

4. An instrument in accordance with claim 3 wherein said asymmetric raised portion is in the form of a FIG. 7.

5. An instrument as defined in claim 1 wherein said recess has a base and side walls.

6. An instrument as defined in claim 1 having a directional orientation wherein said recess is on a forward portion of said hand holdable housing.

7. An instrument as defined in claim 1 having a directional orientation wherein said recess is on a rearward portion of said hand holdable housing.

8. An instrument as defined in claim 1 wherein said instrument has the configuration of a weapon.

9. An instrument as defined in claim 1 wherein the insertion of said bridging contact into said recess completes an electrical circuit in said instrument.

10. An instrument as defined in claim 9 wherein said electrical circuit includes a light which is activatable when said bridging contactor is inserted into engagement with said contact means in said recess.

* * * * *